US009567142B1

(12) United States Patent
Anderson

(10) Patent No.: US 9,567,142 B1
(45) **Date of Patent: *Feb. 14, 2017**

(54) ONE-PIECE DISPENSING CAPSULE WITH INTEGRAL PLUNGER

(71) Applicant: Michael Anderson, Hillsboro Beach, FL (US)

(72) Inventor: Michael Anderson, Hillsboro Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/627,508

(22) Filed: Feb. 20, 2015

Related U.S. Application Data

(63) Continuation-in-part of application No. 13/752,493, filed on Jan. 29, 2013, now Pat. No. 8,960,424, which is a continuation-in-part of application No. 13/478,419, filed on May 23, 2012, now Pat. No. 9,132,950, application No. 14/627,508, which is a continuation-in-part of application No. 13/480,958, filed on May 25, 2012, now Pat. No. 8,839,982.

(60) Provisional application No. 61/490,971, filed on May 27, 2011, provisional application No. 61/490,920, filed on May 27, 2011.

(51) Int. Cl.
*B65D 81/32* (2006.01)
*B65D 51/28* (2006.01)

(52) U.S. Cl.
CPC ..... *B65D 51/2828* (2013.01); *B65D 81/3211* (2013.01)

(58) Field of Classification Search
CPC . B65D 81/32; B65D 81/3211; B65D 51/2821; B65D 51/28; B65D 81/3205; B65D 81/3255; B65D 51/2814; B01F 13/005; B01F 13/0074
USPC ..... 206/222, 219, 220, 568; 215/DIG. 8; 220/521
See application file for complete search history.

(56) References Cited

U.S. PATENT DOCUMENTS

| | | | | |
|---|---|---|---|---|
| 2,445,395 | A | 7/1948 | Greene et al. | |
| 2,653,610 | A | 9/1953 | Smith | |
| 2,659,370 | A | 11/1953 | Smith | |
| 2,721,552 | A | 10/1955 | Nosik | |
| 3,156,369 | A | 11/1964 | Bowes et al. | |
| 3,167,217 | A | 1/1965 | Corsette et al. | |
| 3,220,588 | A * | 11/1965 | Lipari | 206/222 |
| 3,221,917 | A | 12/1965 | De Santo et al. | |
| 3,347,410 | A | 10/1967 | Schwartzman | |
| 3,430,795 | A | 3/1969 | Laufer | |
| 3,443,713 | A | 5/1969 | Kosar | |
| 3,521,745 | A * | 7/1970 | Schwartzman | 206/222 |
| 3,548,562 | A | 12/1970 | Schwartzman | |
| 3,768,697 | A * | 10/1973 | Lerner | B67B 7/26 222/80 |
| 3,802,604 | A | 4/1974 | Morane et al. | |
| 3,924,741 | A | 12/1975 | Kachur et al. | |

(Continued)

*Primary Examiner* — Steven A. Reynolds
(74) *Attorney, Agent, or Firm* — Malin Haley DiMaggio & Bowen, P.A.

(57) ABSTRACT

A dispensing capsule includes a cylindrical cap body surrounding a cylindrical ingredient chamber. The chamber is disposed inside and extends through the cap body and is sealed at the bottom by a lower sealing member. A flexible actuator is attached to the top of the cap body. A moveable plunger is disposed in the chamber and is attached underneath and extends downwardly from the flexible actuator. Upon application of pressure to the flexible actuator, the plunger displaces downward and at least partially breaks the lower sealing member.

1 Claim, 6 Drawing Sheets

(56) References Cited

U.S. PATENT DOCUMENTS

| | | | | |
|---|---|---|---|---|
| 4,024,952 | A | 5/1977 | Leitz | |
| 4,073,406 | A | 2/1978 | Goncalves | |
| 4,247,001 | A | 1/1981 | Wiegner | |
| 4,465,183 | A | 8/1984 | Saito et al. | |
| 4,798,287 | A | 1/1989 | Groves et al. | |
| 4,821,875 | A | 4/1989 | Groves et al. | |
| 4,832,214 | A | 5/1989 | Schrader et al. | |
| 4,903,865 | A | 2/1990 | Janowitz | |
| 4,982,875 | A | 1/1991 | Pozzi et al. | |
| 5,027,872 | A | 7/1991 | Taylor et al. | |
| 5,038,951 | A | 8/1991 | Rizzardi | |
| 5,088,627 | A | 2/1992 | Musel | |
| 5,255,812 | A | 10/1993 | Hsu | |
| 5,352,196 | A | 10/1994 | Haber et al. | |
| 5,370,222 | A | 12/1994 | Steigerwald et al. | |
| 5,482,172 | A | 1/1996 | Braddock | |
| 5,598,951 | A | 2/1997 | DeBano, Jr. | |
| 5,782,345 | A | 7/1998 | Guasch et al. | |
| 5,794,802 | A | 8/1998 | Caola | |
| 5,839,573 | A | 11/1998 | Morini | |
| 5,863,126 | A | 1/1999 | Guild | |
| 5,884,759 | A | 3/1999 | Gueret | |
| 5,950,819 | A * | 9/1999 | Sellars | 206/221 |
| 6,003,728 | A * | 12/1999 | Elliott | 222/81 |
| 6,098,795 | A | 8/2000 | Mollstam et al. | |
| 6,116,445 | A | 9/2000 | Ikemori et al. | |
| 6,148,996 | A | 11/2000 | Morini | |
| 6,230,884 | B1 | 5/2001 | Coory | |
| 6,257,463 | B1 | 7/2001 | De Polo | |
| 6,305,576 | B1 * | 10/2001 | Leoncavallo | 222/83.5 |
| 6,364,103 | B1 | 4/2002 | Sergio et al. | |
| 6,372,270 | B1 | 4/2002 | Denny | |
| 6,412,659 | B1 | 7/2002 | Kneer | |
| 6,435,341 | B1 | 8/2002 | Nobbio | |
| 6,450,367 | B1 | 9/2002 | Sittler | |
| 6,477,743 | B1 | 11/2002 | Gross et al. | |
| 6,513,650 | B2 | 2/2003 | Mollstam et al. | |
| RE38,067 | E | 4/2003 | Gueret | |
| 6,571,994 | B1 | 6/2003 | Adams et al. | |
| 6,609,634 | B2 | 8/2003 | De Laforcade et al. | |
| 6,644,471 | B1 | 11/2003 | Anderson | |
| 6,679,375 | B1 | 1/2004 | Coory | |
| 6,763,939 | B2 | 7/2004 | Alticosalian | |
| 6,772,910 | B1 | 8/2004 | Coory | |
| 6,854,595 | B2 | 2/2005 | Kiser | |
| 6,874,661 | B2 | 4/2005 | Timmerman et al. | |
| 6,908,011 | B2 | 6/2005 | Cho | |
| 6,921,087 | B2 | 7/2005 | Takahashi et al. | |
| 6,926,138 | B1 | 8/2005 | Basham et al. | |
| 7,055,685 | B1 | 6/2006 | Patterson et al. | |
| 7,175,049 | B2 | 2/2007 | Kastenschmidt et al. | |
| 7,249,690 | B2 | 7/2007 | Smith et al. | |
| 7,252,091 | B1 | 8/2007 | Wayne et al. | |
| 7,261,226 | B2 | 8/2007 | Adams et al. | |
| 7,325,676 | B2 | 2/2008 | Galaz Rodriguez | |
| 7,377,383 | B2 | 5/2008 | Henry | |
| 7,464,811 | B2 | 12/2008 | Patterson et al. | |
| 7,503,453 | B2 | 3/2009 | Cronin et al. | |
| 7,562,782 | B2 | 7/2009 | Yorita | |
| 7,568,576 | B2 | 8/2009 | Sweeney, Jr. et al. | |
| 7,614,513 | B2 | 11/2009 | Anderson | |
| 7,854,104 | B2 | 12/2010 | Cronin et al. | |
| 7,874,420 | B2 | 1/2011 | Coon | |
| 7,886,922 | B2 | 2/2011 | Seelhofer | |
| 7,900,787 | B2 | 3/2011 | Oh et al. | |
| 7,951,109 | B2 | 5/2011 | Anderson | |
| 8,083,055 | B2 | 12/2011 | Simonian et al. | |
| 8,141,700 | B2 | 3/2012 | Simonian et al. | |
| 8,215,481 | B1 | 7/2012 | Knickerbocker | |
| 8,960,424 | B1 * | 2/2015 | Anderson | 206/222 |
| 2002/0040856 | A1 | 4/2002 | Mollstam et al. | |
| 2003/0072850 | A1 | 4/2003 | Burniski | |
| 2004/0020797 | A1 | 2/2004 | Fontana | |
| 2004/0112770 | A1 | 6/2004 | Oswald | |
| 2004/0188465 | A1 | 9/2004 | Timmerman et al. | |
| 2004/0200740 | A1 | 10/2004 | Cho | |
| 2004/0200741 | A1 | 10/2004 | Cho | |
| 2005/0115845 | A1 | 6/2005 | Cho | |
| 2005/0161348 | A1 | 7/2005 | Morini | |
| 2005/0236424 | A1 | 10/2005 | Walters et al. | |
| 2006/0006077 | A1 | 1/2006 | Mosher et al. | |
| 2006/0118435 | A1 | 6/2006 | Cronin et al. | |
| 2007/0051689 | A1 | 3/2007 | Anderson | |
| 2008/0125704 | A1 | 5/2008 | Anderson | |
| 2008/0202950 | A1 | 8/2008 | Anderson | |
| 2009/0020494 | A1 | 1/2009 | Seelhofer | |
| 2009/0308831 | A1 | 12/2009 | Anderson | |
| 2010/0000960 | A1 | 1/2010 | Anderson | |
| 2010/0200437 | A1 | 8/2010 | Coon | |
| 2011/0290677 | A1 | 12/2011 | Simonian et al. | |
| 2011/0290678 | A1 | 12/2011 | Simonian et al. | |
| 2012/0199503 | A1 * | 8/2012 | Dyrbye | B65D 47/243 206/222 |

* cited by examiner

ONE-PIECE DISPENSING CAPSULE WITH INTEGRAL PLUNGER

CROSS REFERENCE TO RELATED APPLICATIONS

This application is a continuation-in-part of co-pending U.S. patent application Ser. No. 13/752,493 filed on Jan. 29, 2013 now U.S. Pat. No. 8,960,424 issued on Feb. 24, 2015, which is a continuation-in-part of U.S. patent application Ser. No. 13/478,419 filed May 23, 2012, which claims the benefit of priority to U.S. Provisional Patent Application No. 61/490,971 filed May 27, 2011. This application is also a continuation-in-part of co-pending U.S. patent application Ser. No. 13/480,958 filed May 25, 2012 now U.S. Pat. No. 8,839,982 issued on Sep. 23, 2014, which claims the benefit of priority to U.S. Provisional Patent Application No. 61/490,920 filed May 27, 2011.

STATEMENT REGARDING FEDERALLY SPONSORED RESEARCH OR DEVELOPMENT

N/A

BACKGROUND OF THE INVENTION

Most if not all liquids, creams, gels and even certain powders and other substances are formulated and created for the longest shelf life and not necessarily for optimal performance and/or usefulness. There are many ingredients and/or combinations of ingredients that have reduced shelf life due to requiring combinations of liquid substances. In most all cases when any ingredients are exposed to one another, including air, deterioration begins and the clock on the limited shelf life starts. Also in most products in any category, "Shelf Life" is the key factor with respect expiration dates based on the product and category.

Several attempts have been made to design capsules and containers to improve the shelf life of compositions such as gels, liquids, powders and the like however the majority of the available devices rely on a plurality of interconnected parts which are not cost effective to manufacture and assemble. The present invention is designed to be inexpensive to mass produce, fill and seal to be able to deliver an affordable dispensing capsule in virtually any application and category. This invention can be made from a one piece mold or more pieces depending on the desired application with features and benefits for keeping ingredients separate and fresh until time of use. This invention allows formulas and new products in any categories to be invented and made for desired end effects and not for what has to be done do to normal packaging and manufacturing and eliminating many unhealthy ingredients that are currently and normally used to produce most products. The present invention, therefore, is useful for packaging ingredients such as enzymes, calcium and magnesium with bio flavinoids vitamin C, probiotics creatine and many more. Moreover, the present invention allows for the mixing of a plurality of ingredients by providing a multi-chambered dispenser configuration. This provides a substantial improvement over the prior art with respect to shelf life and overall versatility.

It is, therefore, to the effective resolution of the aforementioned problems and shortcomings of the prior art that the present invention is directed. However, in view of the container capsules and related devices in existence at the time of the present invention, it was not obvious to those persons of ordinary skill in the pertinent art as to how the identified needs could be fulfilled in an advantageous manner.

DETAILED DESCRIPTION

Figure 1:
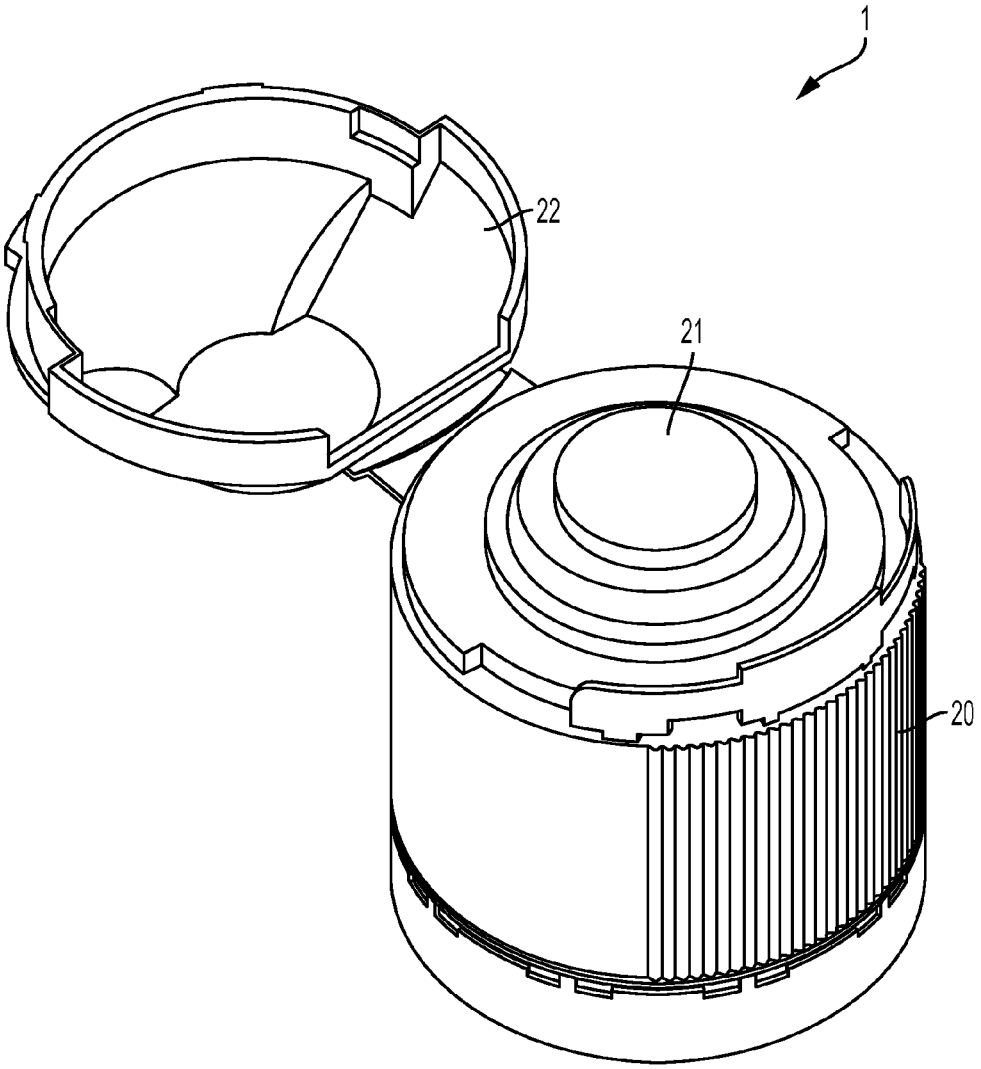
FIG. 1 is an perspective view of one embodiment of the dispensing capsule of the present invention.

FIG. 1 is a perspective view of one embodiment of the dispensing capsule 1. The dispensing capsule 1 generally comprises a cap body 20 having a flexible actuator 21 disposed thereon. In some embodiments, a hingeable lid 22 is removably received over the flexible actuator 21 and is releasably retained by the capsule body 20.

Figure 2A:
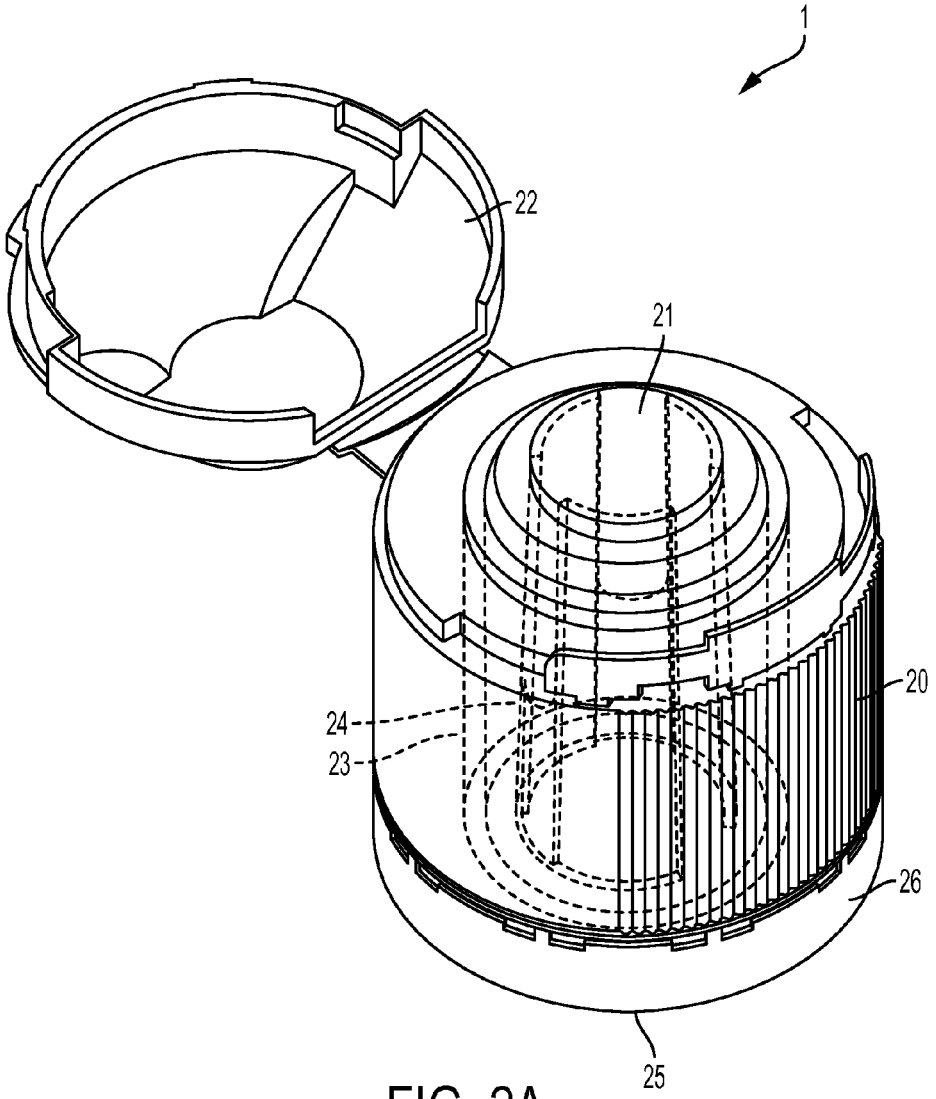
FIG. 2A is a perspective view of the dispensing capsule.

FIG. 2A is a perspective view of the assembled dispensing capsule 1. The cap body 20 is configured to be removably received on a target container such that the capsule can dispense one or more ingredients into the container for mixture and eventual use. The cap body 20 delimits the outer race of the capsule 1 and surrounds a cylindrical chamber 23. The chamber 22 is disposed inside and extends through the cap body 20 and, in some embodiments, is cylindrical and coaxial with the cap body 20. In some embodiments, the chamber 23 is smaller in diameter than the cap body 20 such that the cap body 20 can fit around an open top or spout of a target container with the chamber 23 disposed partially in the container, typically within the neck of the target container, as shown and described further below. Attached to the top of the cap body 20 is the flexible actuator 21 which, in some embodiments, comprises a bellow or stepped-type flexible member that is depressible under manual or automatic pressure. One or more ingredients 23*a* are contained in the chamber 23, which chamber 23 is sealed at the bottom by a lower sealing member 25. In some embodiments, the hingeable lid 22 when closed entirely covers the flexible actuator 21, preventing premature activation of the device.

Figure 2B:
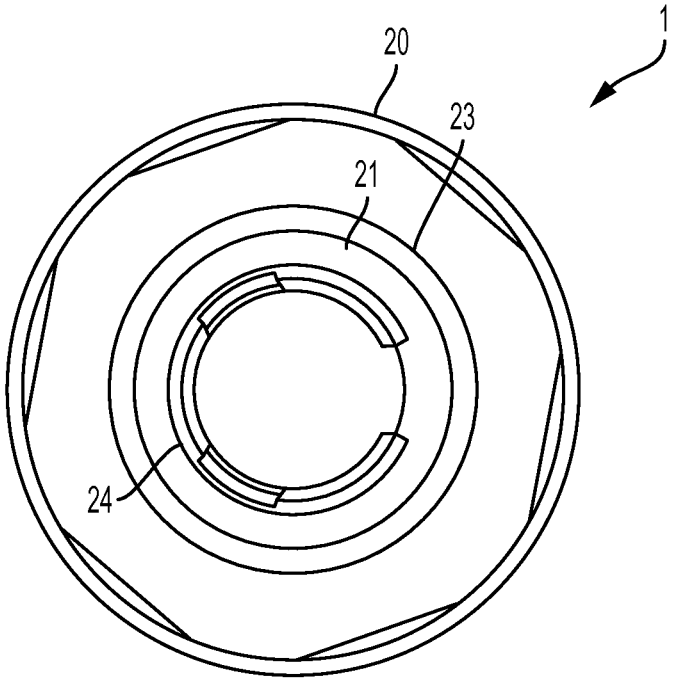
FIG. 2B is a bottom view of the dispensing capsule.

FIG. 2B is a bottom view of the capsule 1 showing arrangement of the various components of the capsule 1. Cap body 20 is axially aligned with chamber 23. Also shown is moveable plunger 24 which is disposed in chamber 23 and extends downward from flexible actuator 21. In some embodiments, the capsule 1 is manufactured as a single piece, with moveable plunger integral with the underside of the flexible actuator 21.

Figure 3A:
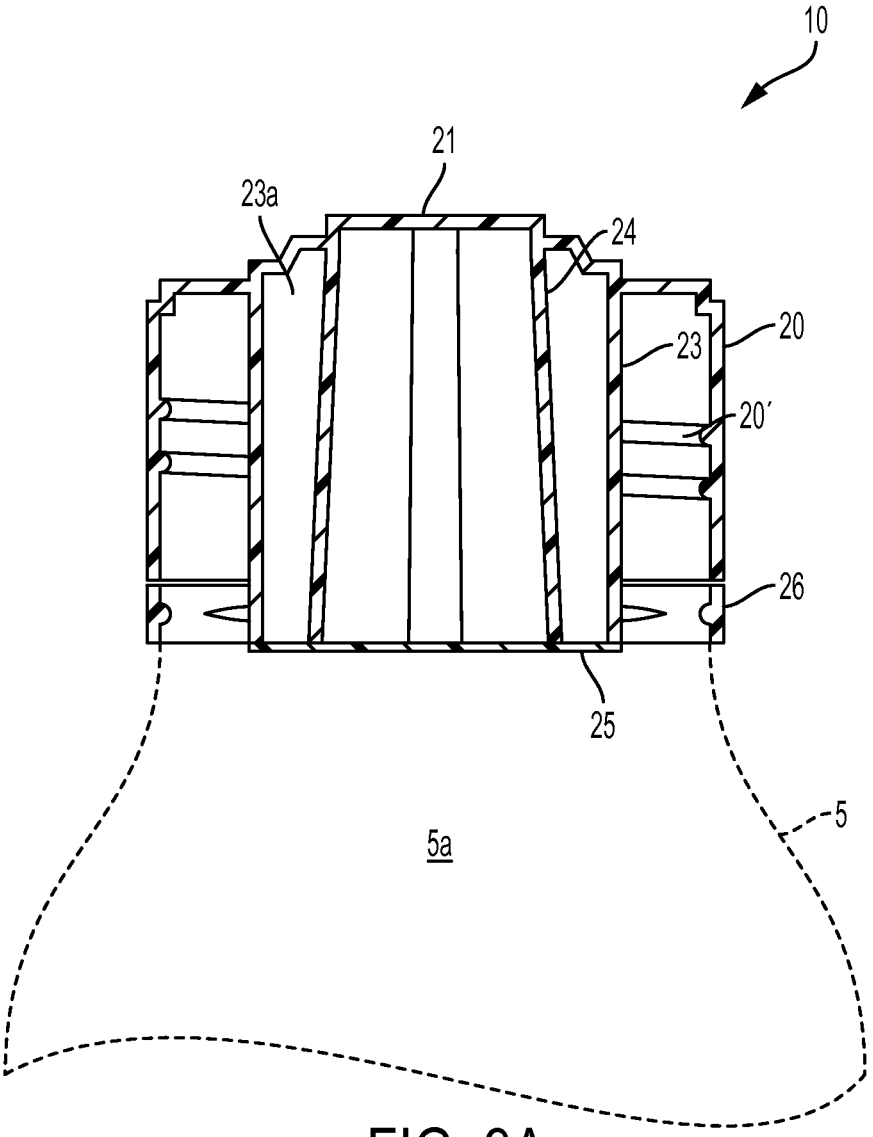
FIG. 3A is a section view of one embodiment of the dispensing capsule of the present invention in a pre-activation state.
Figure 3B:
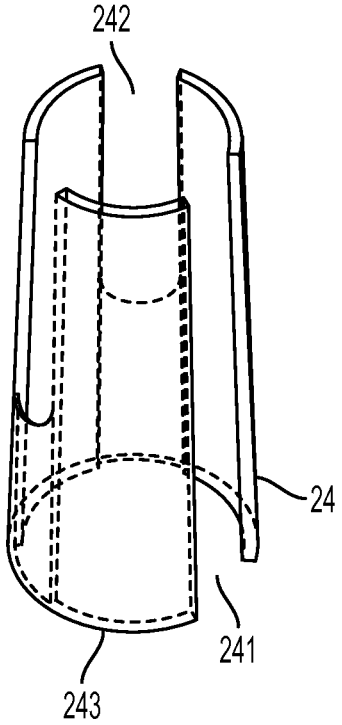
FIG. 3B is a close up view of the plunger of the dispensing capsule.
Figure 3C:
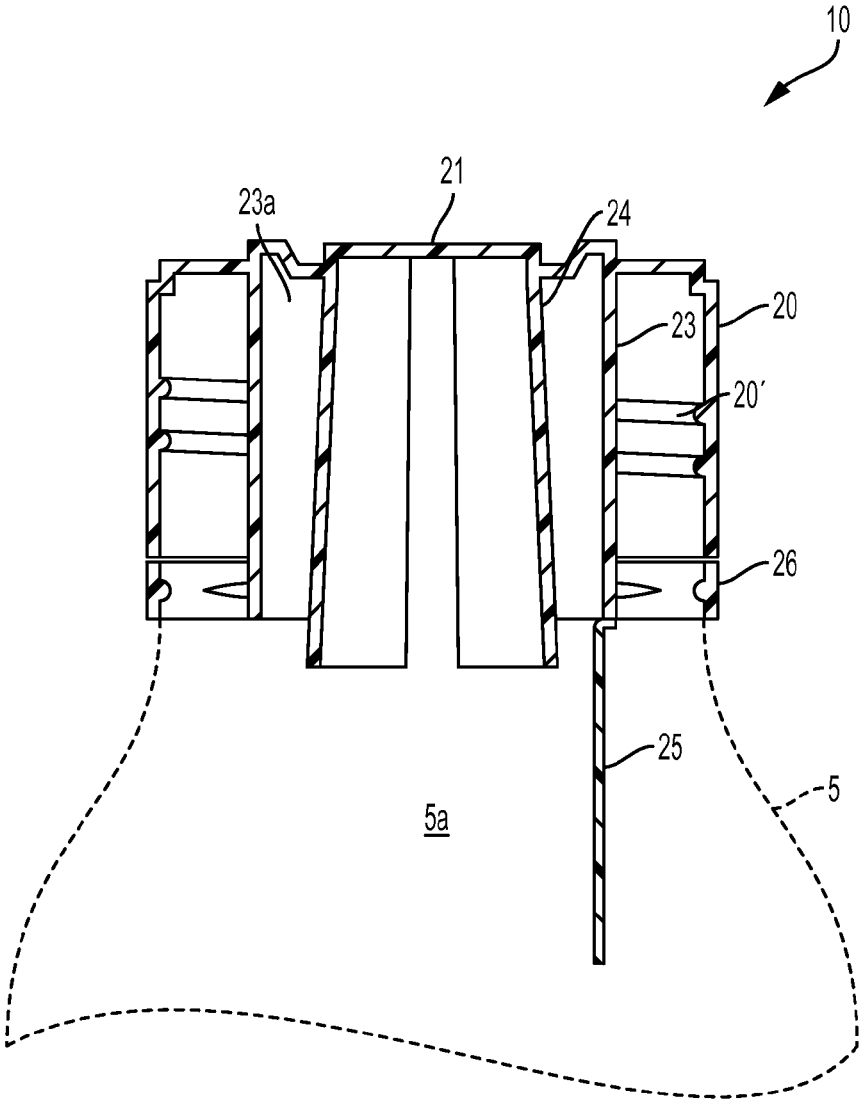
FIG. 3C is a section view of one embodiment of the dispensing capsule of the present invention in an actuated state.

As shown in FIGS. 3A-3C, actuation of the dispensing capsule 1 is accomplished by way of moveable plunger 24 which is disposed and moveable within chamber 23. In some embodiments, plunger 24 is an extension of flexible actuator 21 projecting into the chamber 23 from the underside thereof. In some embodiments, plunger 24 has a generally conical shape diverging away from flexible actuator 21. As shown in FIG. 3B, in some embodiments, plunger 24 has a triangular cutaway 241 along its surface area and may further include one or more vent windows 242 disposed in spaced apart relation on the surface of the plunger 24. In some embodiments, as shown, the cutaway 241 extends along the entire length of the plunger 24 such that the plunger 24 forms an incomplete or partial cone. In some embodiments, the plunger 24 has an angled or beveled distal tip 243 which is effective for piercing or breaking lower sealing member 25.

With reference to FIG. 3A, shown is a section view of the dispensing capsule of the present invention in a pre-actuated state. Here, the cap body 20 is removably received on a container 5. Shown are inner threads 20' which are disposed on an inner portion of cap body 20. Threads 20' are configured to threadingly engage a target container 5. In some embodiments, threads 20' of cap body 20 are engaged with corresponding container threads of a target container 5. Other engagements, such as snap fitments and the like may be as equally suitable as the threaded engagement. From here it can be seen that, which the capsule 1 seated on target container 5, the chamber 23 of capsule 1 is received in the neck of the container 5 and is ready for actuation. Disposed within chamber 23 are one or more ingredients 23*a*. In some embodiments, container 5 may contain a second ingredient 5*a*. Towards the top of the capsule 1, hinged lid 22 is the open position, ready flexible actuator 21 for use.

With reference to FIGS. 3A and 3C, in order to actuate the device, manual or automatic pressure is applied downwardly to flexible actuator. This pressure causes the flexible actuator 21 to deform such that the plunger 24 displaces downwardly within chamber 23, until the distal tip 243 punctures and/or breaks lower sealing member 25, causing the one or more ingredients 23*a* to be dispensed from the cap body into container 5. In the case where container 5 contains a second ingredient 5*a*, the two ingredients mix.

After the dispensing capsule 1 has been actuated, it can be removed from the target container 5 for access to the mixture in the container 5. In some embodiments, the capsule 1 is pre-installed on a target container 5 and may be sealing engaged therewith by a circumferential frangible line-of-weakening seal 26 attaching the container 5 to the bottom edge of the cap body 20.

To further enhance the usability and effectiveness of the dispensing capsule 1, the window vents 242 are provided in plunger 24 to assure that the one or more ingredients 23*a* are entirely cleared from the dispensing capsule. To that end, the window vents 242 allow the flow of liquid and in and out of the chamber 23 to allow for the chamber 23 to be completely flushed of ingredients 23*a* after actuation. Flushing the capsule 1 after actuation can be accomplished by upending the container 5 (with capsule 1 installed) or by shaking or otherwise disturbing the device such that a sufficient amount of liquid enters the dispensing capsule 1 from the bottom. This helps to alleviate the problem of residue build up or unused ingredients 23*a* remaining in the chamber 23, particularly in the vicinity of the lower sealing member 25.

In some embodiments, the dispensing capsule 1 includes cylindrical cap body 20 surrounding cylindrical ingredient chamber 23, the chamber 23 disposed inside and extending through cap body 20 and sealed by a lower sealing member 25. Flexible actuator 21 is attached to the top of cap body 20. Moveable plunger 24 is disposed in chamber 23 and is attached underneath and extends downwardly from flexible actuator 21. Upon application of pressure to flexible actuator 21, plunger 24 displaces downward and at least partially breaks the lower sealing member 25.

It is appreciated that the capsule of the present invention can comprise any combination of materials including plastics, rubbers, aluminum, resins, and the like. The capsule may also be sized and shaped to accommodate fitment on any desired container such as bottles, IV bags, pouches, and the like. Furthermore, the threaded engagement with the container may be substitute for various snap-on or other releasable fitments known in the art.

It is further appreciated that the lower sealing member 25 may comprise a variety of plastic and foil-like materials. In some embodiments, the sealing member comprises a thin plastic or resin material having one or more lines of weakening to allow for dispensing of the first ingredient. In other embodiments, the sealing member may comprise a foil or paper material equally suitable to be broken by the plunger action described above.

The chamber 23 can contain any liquid, powder and or gasses and or micro/nano encapsulation in any combination desired. The dispensing capsule can be mounted or applied at any location of a container including a bottle, pouch, can, IV bag, drum or tote. In some embodiments, the capsule is suited to be received on the threaded opening of such containers in order to provide a leak-free fitment. The chamber of the dispensing capsule stores any desired ingredient and may be dimensioned as desired to fit a variety of applications. The size and shape of the capsule of the present invention should not be construed as limited to the sizes and shapes shown in the drawings herein. Rather, the volume of the chamber and the diameter of the various components can vary as desired and/or can vary depending on the size and shape of the intended container or other parameters. Further, the chamber need not be filled completely, but rather can accept any volume of an ingredient desired depending on mixing parameters and the desired final product.

By way of example only, the device can be used for drinks, hair care, pet products, drugs, over the counter medications, cleaning products, soups, dressings, nitrogen, fuels and engine cleansing, oils, waxes, pH enhancers, oral care, oxygen, adhesives and other categories of use depending on the ingredients and formulas. It is appreciated that the dispensing capsule allows for on-demand dispensing of a product or component of a product for mixing with another ingredient or ingredients in the container to which it is attached. Also a coating of any type of moisture absorbent can be applied to the inside of the chamber to act as a desiccant and allow for moisture absorption of any excess moisture that may be contained inside the invention when filled and sealed.

Due to the integral construction of the moveable plunger with the underside of the flexible actuator 21, the capsule 1 can be manufactured as a single piece, thus eliminating a high cost to manufacture other dispensing caps that are multiple pieces and difficult to fill and seal the ingredients desired. Furthermore, due to the encapsulated capsule excluding the sealing area the invention allows the ingredients to remain moisture free and have an unusually long shelf life and allowing with the sealed chamber to combine liquids and powders and oils and other ingredients to be sealed and stored separately if desired to prevent any reaction with one another.

The instant invention has been shown and described herein in what is considered to be the most practical and preferred embodiments. It is recognized, however, that departures may be made therefrom within the scope of the invention and that obvious modifications will occur to a person skilled in the art.

What is claimed is:

1. A dispensing capsule, comprising:

a cylindrical cap body surrounding a cylindrical ingredient chamber, said chamber disposed inside and extending through said cap body and sealed by a lower sealing member;

a flexible actuator comprising a stepped flexible element integrally attached to said cap body;

a vertically moveable plunger disposed in said chamber and integrally attached to and extending downwardly from underneath said flexible actuator;

said plunger having a triangular cutaway along its entire length so as to form an incomplete cone having one or more window vents to facilitate flow of liquid into and out of said chamber;

wherein upon application of pressure to said flexible actuator, said plunger displaces downward and at least partially breaks said lower sealing member; and wherein said cap body, flexible actuator, and plunger are integrally constructed as a single piece.

* * * * *